US005503498A

United States Patent [19]

Scheiwiller

[11] Patent Number: 5,503,498

[45] Date of Patent: Apr. 2, 1996

[54] PAVING STONE WITH LATERAL SPACERS

[76] Inventor: René Scheiwiller, Postfach 266, 6052 Hergiswil, Switzerland

[21] Appl. No.: 360,774

[22] PCT Filed: Feb. 22, 1994

[86] PCT No.: PCT/EP94/00501

§ 371 Date: Dec. 23, 1994

§ 102(e) Date: Dec. 23, 1994

[87] PCT Pub. No.: WO94/25677

PCT Pub. Date: Nov. 10, 1994

[30] Foreign Application Priority Data

Apr. 23, 1993 [DE] Germany ..... 43 13 342.8

[51] Int. Cl.[6] ..... E01C 5/00

[52] U.S. Cl. ..... 404/34; 404/37; 404/41; 52/596; 52/603

[58] Field of Search ..... 404/34, 37, 38, 404/40, 41, 42; 52/603, 604, 605, 311.1

[56] References Cited

U.S. PATENT DOCUMENTS 3,494,266 2/1970 Baumberger .
5,267,810 12/1993 Johnson ..... 404/41

FOREIGN PATENT DOCUMENTS 0060961 5/1984 European Pat. Off. .
0227144 7/1987 European Pat. Off. .
2610735 9/1977 Germany .
8302622 6/1983 Germany .
3116540 9/1983 Germany .
8700821 6/1987 Germany .
8901920 7/1989 Germany .
3804760 8/1989 Germany .
8913734 10/1990 Germany .
9000928 10/1990 Germany .
8913777 10/1990 Germany .
5112903 5/1993 Japan .

*Primary Examiner*—Ramon S. Britts
*Assistant Examiner*—Pamela A. O'Connor
*Attorney, Agent, or Firm*—Spencer & Frank

[57] ABSTRACT

A paving stone configured to be arranged in a paving stone bond in an area-covering grid-shaped lattice of paving stones comprised of lattice elements. The paving stone has side walls and includes a plurality of spacers disposed on the side walls thereof. Each of the spacers has an abutting surface adapted to be positively joined to a respective abutting surface of a spacer on an adjacent paving stone in the lattice of paving stones. In this manner, a crossing joint is formed between the paving stones. The abutting surface of each of the spacers includes a stepped contour for positively meshing with a corresponding stepped contour on the respective abutting surface of the spacer on the adjacent paving stone, the plurality of spacers being disposed on the side walls of the paving stone such that the stepped contours of their respective abutting surfaces are identically oriented in either of two rotational directions defined around the side walls of the paving stone.

19 Claims, 4 Drawing Sheets

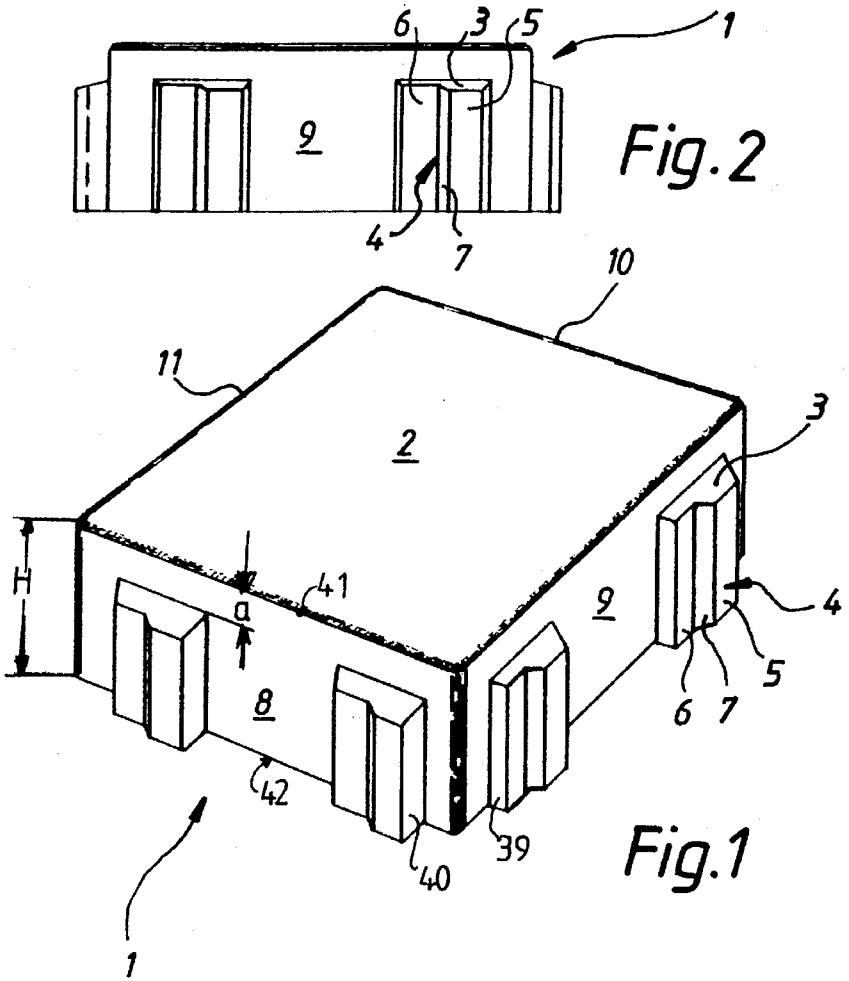
Fig. 1
Fig. 2
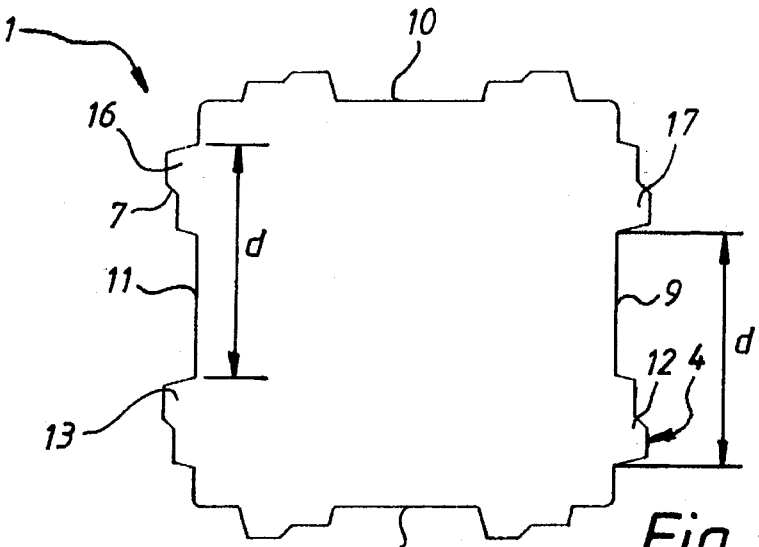
Fig. 3
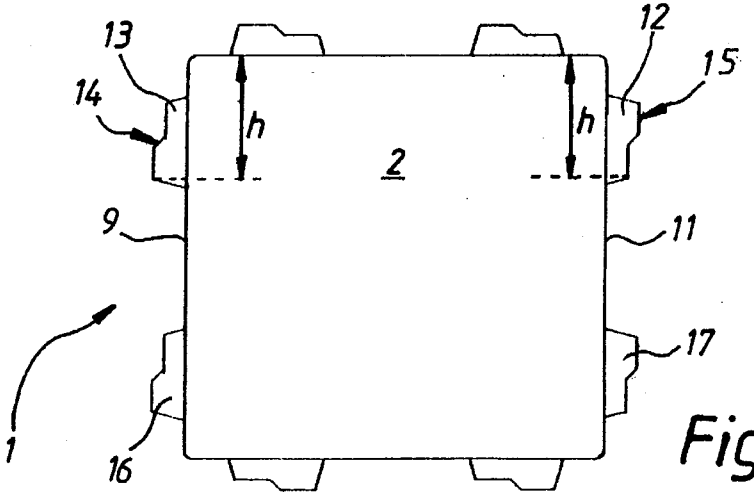
Fig. 4

PAVING STONE WITH LATERAL SPACERS

FIELD OF THE INVENTION

The invention relates to a paving stone with lateral spacers adapted to be arranged in a paving stone bond in an area-covering grid-shaped lattice of paving stones comprised of lattice elements.

BACKGROUND OF THE INVENTION

A wide variety of paving stones have become known up to now. For example, DE 31 16 540 and U.S. Pat. No. 3,494,266 describe paving stones whose outer contour is shaped in such a way that they can mesh with neighboring stones.

By this meshing, they are secured against lateral displacement, as a result of which the stability of a paving stone bond laid from such paving stones is increased.

In the case of such stones, although the stability of the paving stone bond is improved by the positive meshing, joints running right through, in which for example grass or moss can grow for decorative purposes, are not possible. In addition, the rainwater cannot seep very well down into the ground through such a positively joined-together paving stone bond.

To combine the advantages of meshing teeth in the outer contour with the advantages of intermediate joints, a stone such as that described in EP 0 060 961 B1 was created.

This stone again has in its lower region an outer contour for meshing with neighboring stones, but in its upper third is stepped with respect to the lower region. The upper third has a quadrangular outer shape, which has a smaller extent than the lower meshed region. On the upper side of this quadrangular stepped region there is the walk-on face.

If such a stone is laid in a bond, it is secured by the meshing teeth in its lower region against lateral displacement and in the upper region there is sufficient space for forming joints.

However, in such a bond of stones there is the disadvantage that water cannot seep very well into the ground underneath on account of the outer contours in the lower region engaging positively in one another over their entire extent.

On the other hand, paving stones with lateral spacers for forming uniform joints between the individual paving stones have also become known already in a variety of instances. Such stones are described, for example, in DE 89 01 920, DE 87 00 821, EP 0 227 144 and DE 83 02 622.

In the case of all these configurations, the spacers are designed such that, during laying in a bond of stones, they are made to abut against only correspondingly abutting sides parallel to the side walls of the paving stones. They thereby abut either against the corresponding abutting faces of the spacers or of the side walls of neighboring stones.

Although such spacers provide the desired spacing between the side walls of the stones, they do not provide the latter with any additional hold with respect to a displacement parallel to the side walls.

DE 89 13 777 describes a paving stone with spacers in which the spacers have sloping, non side-parallel abutting faces for securing the stones against lateral displacement.

Although such a paving stone is adequately anchored against lateral displacement in its paving stone bond, such a stone has stone sides having varying designs, even in the case of a square outline. This means increased effort both during the production of such a stone and during laying in a paving stone bond, which entails a corresponding increase in costs in the case of both operations.

Finally, a paving stone with spacer which has in each case an outer structure serving for positive connection has become known from DE 90 00 928-U or DE 38 04 760 A1. These structures are, however, arranged in a complicated manner, in particular in the case of the first-mentioned document, and require extremely precise laying of these stones, which particularly in the case of machine laying does not occur.

The invention therefore has the object of proposing a paving stone with which on the one hand the formation of uniform joints and unproblematical seeping away of water are ensured and on the other hand, however, anchorage with regard to lateral displacement of the paving stone occurs, while at the same time to said stones are easy to lay.

SUMMARY OF THE INVENTION

On the basis of a paving stone of the above-mentioned type, the object of the invention is achieved by a paving stone having side walls and comprising a plurality of spacers disposed on the side walls thereof. Each of the spacers has an abutting surface adapted to be positively joined to a respective abutting surface of a spacer on an adjacent paving stone in the lattice of paving stones. In this manner, a crossing joint is formed between the paving stones. The abutting surface of each of the spacers includes a stepped contour for positively meshing with a corresponding stepped contour on the respective abutting surface of the spacer on the adjacent paving stone, the plurality of spacers being disposed on the side walls of the paving stone such that the stepped contours of their respective abutting surfaces are configured similarly in either of two rotational directions defined around the side walls of the paving stone.

Advantageous further developments and configurations of the invention are possible as will be described further below.

Accordingly there is provided a paving stone for fitting into a paving stone bond, which is divided into an area-covering, grid-shaped lattice and is provided with lateral spacers which have in each case a preferably stair-shaped or stepped abutting face for positive fitting onto a complementary abutting face of a spacer of a neighboring stone. The abutting face of each spacer consequently has a spatial structure which serves for meshing with the complementary abutting face of a spacer of a neighboring stone, the stepping of the abutting faces on a paving stone taking place in the same rotational direction.

Paving stones designed in such a way are firmly anchored, even with regard to lateral displacements, by the positive meshing of the spacers with one another in a paving stone bond. The stability, and consequently the loadability, of a paving stone bond joined together from such stones is distinctly increased as a result of the above configuration.

In addition, in the case of a stone shape according to the invention, the advantages in the use of spacers are retained, i.e. the seeping of water through the existing joints is ensured at all times with uniform joint widths. The joint between the paving stones may, furthermore, be decoratively fashioned in virtually any desired way in a manner corresponding to the respective intended use. Thus, for example, the shape of the joint is not in any way restricted to straight edges. Rather, the borders of the paving stones may, as desired, be curved, serrated or provided with other shapings.

In a preferred embodiment, two or more spacers are provided on one paving stone side and the same number of spacers are provided with equal spacing with respect to one another on the complementary side of the adjacent paving stone. This offers the advantage that a so-called cross bond can be laid at any time with a single type of paving stone. The spacers of one side and the associated complementary side are arranged such that for each spacer there is a complementary spacer and that all of these pairs of spacers can simultaneously engage positively in one another.

To be able, if appropriate, to lay a decorative pattern in a mosaic-like manner into a paving stone bond, paving stones of various sizes are necessary. In such cases, use is advantageously made of paving stone sizes which in each case occupy an integral number of lattice elements in the grid-shaped lattice of the paving stone bond.

Particularly favorable for forming an area-covering lattice grid is a stone which, apart from the spacers, has the outline of a parallelogram. The individual lattice elements of the lattice grid may then likewise be provided by parallelograms with sides in each case extended with respect to the paving stone by half a joint width to both ends of the paving stone.

If, for example, the spacers to be assigned to each of two opposite sides are arranged at the same height along their side walls, an alignment of the paving stones in a so-called cross bond without offset between the neighboring stones in a straight alignment is possible. This also applies, of course, if the lattice lines do not cross at 90°.

Preferably, two or more spacers of the same side wall are provided with the same abutting faces and are attached at the same distance from this side wall. The distance of these abutting faces from one another in the longitudinal direction of their side wall is in this case chosen such that it is equal to the length of one lattice element divided by the number of spacers provided per lattice element.

Such a paving stone may be arranged in a so-called stretching bond, in which the paving stones of one row have an offset with respect to the next row. In the case of a paving stone bond with only stones of the same size, the number of spacers designed as described above of a side wall determines the number of offset possibilities in the direction of this side wall.

If two opposite side walls of a paving stone according to the invention are designed symmetrically with respect to a rotation of the stone through 180°, this on the one hand reduces the effort during production of the stone and on the other hand permits the fitting of a stone into a bond in two orientations. This is advantageous in particular in the case of a rectangular paving stone, since it is possible in this case to join the paving stones onto one another without constantly having to ensure matching spacers.

In the case of a paving stone which is parallelogram-shaped, for example, rectangular, spacers having various designs may be provided on sides joined with one another. As a result, if desired, the joint width of two crossing joints can be designed to vary. As a rule, however, all the joints are provided with the same width.

A square paving stone is preferably designed rotationally symmetrically with respect to a rotation through 90°. Such a stone can be fitted in any orientation into a paving stone bond.

In an advantageous configuration of a paving stone according to the invention, the abutting faces of the spacers are designed such that they permit the fitting of a paving stone into a partially laid paving stone bond by lateral displacement in the horizontal plane of the bond. This is to be considered in particular also when the stone to be fitted already finds neighboring stones which are laid along two crossing lattice lines. A paving stone to be fitted by displacement into such a partially laid paving stone bond consequently fits in simultaneously with two mutually adjacent paving stone walls. Such a configuration of paving stones according to the invention offers enormous advantages, in particular in the machine laying of a paving stone bond, over meshing profiles, in which the stones are to be lowered from above into the partially laid bond.

In a preferred configuration of such a paving stone, each stair-shaped or step-shaped abutting face of the spacer is designed such that it has two regions, which are approximately parallel to-the associated side wall, are stepped from each other, i.e. have different distances from the side wall, and are joined by a joining face which is preferably sloping or, perpendicular to the side wall, planar. In a bond, such paving stones contact one another exclusively at these corresponding abutting faces of their spacers, each spacer extending over the center line of the joint, i.e. the lattice line. The center line in this case divides the region of the preferably sloping joining face of the stepped side walls.

The sloping planar faces are inclined such that they are all together either only rising or only falling with respect to their paving stone side wall when running around the outer contours of the paving stone in a certain rotational direction. As a result, an exemplary configuration of abutting faces is obtained, in which the possibility of fitting into a partially laid paving stone bond, as specified above, is always possible.

For this purpose, however, other shapes are also conceivable. It only has to be ensured that the angle range by which a paving stone side can be fitted onto the side associated with it of the bond of stones by lateral displacement overlaps by the thus-defined push-in angle range of a paving stone side neighboring it, as to be explained in more detail further below with reference to an example.

BRIEF DESCRIPTION OF THE DRAWINGS

An exemplary embodiment of the invention is explained in more detail by the description which follows and is represented in the drawing, in which:

FIG. 1 shows a perspective view of a paving stone according to the invention, FIG. 2 shows a side elevational view of a paving stone according to FIG. 1, FIG. 3 shows a top plan view of a paving stone according to FIG. 1, FIG. 4 shows a bottom plan view of a paving stone according to FIG. 1.

DETAILED DESCRIPTION OF THE INVENTION

Figure 5:
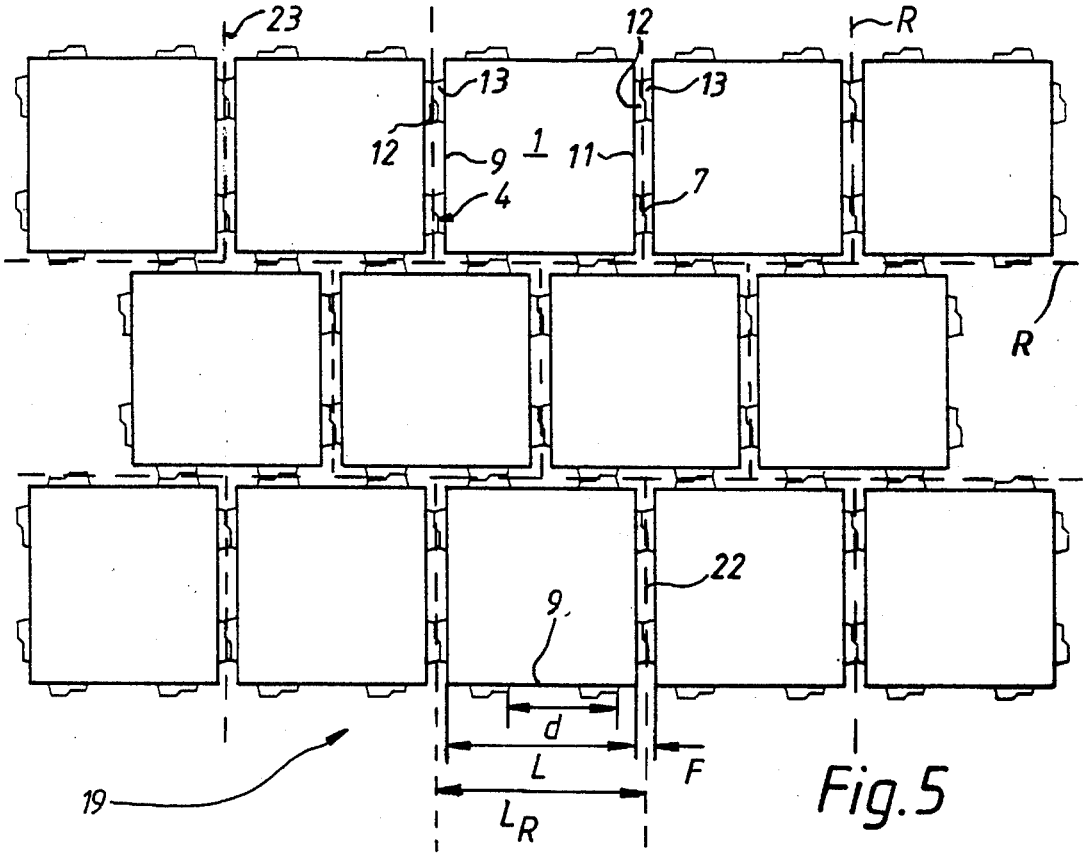
FIG. 5 shows a stretching bond of paving stones according to FIG. 1.

The paving stone 1 according to the invention, as represented in FIGS. 1 to 4, of substantially cuboidal design has a square walk-on face 2 and lateral spacers 3. The lateral spacers 3 have a stepped abutting face 4. The abutting face 4 is composed of two side-parallel regions or step regions 5, 6 and a joining face or sloping face 7, joining these regions. Attached on each side wall 8 to 11 are two spacers 3. They are arranged at a distance d, which in this specific exemplary embodiment is equal on all four side walls 8 to 11. In addition, as shown in FIG. 1, each spacer includes transitional regions and 40, which join step regions 5 and 6 to the associated side wall. Regions 39 and 40 are angled with respect to the associated side wall, and may be perpendicular thereto.

Two mutually complementary spacers 12, 13, to be assigned to each other, of two opposite sides 9, 11 of the paving stone 1 are in each case arranged at the same height h with respect to the length of their side walls 9, 11. The two abutting faces 14, 15 of the complementary spacers 12, 13 to be assigned to each other have an identical profile. In the specific exemplary embodiment shown, the abutting faces 14, 15 are additionally rotationally symmetrical with respect to a rotation through 180°. As a result, the two side walls 9, 11 with the associated spacers 12, 13 and 16, 17, respectively, can be designed symmetrically with respect to a rotation of the paving stone through 180°.

In the present exemplary embodiment, in which the cuboidal basic body of the paving stone 1 has a square and consequently also a parallelogram-shaped or rectangular outline, as evident from the walk-on face 2, all four side walls 8 to 11 are identically designed. The complete paving stone 1 is symmetrical with respect to a rotation through 90°. As a result, each side 9 to 11 of a paving stone 1 can be joined onto any side 9 to 11 of a neighboring paving stone. The paving stone shown in FIG. 1 further includes an upper peripheral edge 41, and a lower peripheral edge 42 disposed at a distance H with respect to upper edge 41, the distance thus corresponding to a height of the paving stone. As shown in FIG. 1, the plurality of spacers are disposed at a distance a from upper edge 41, the distance a preferably being equal to one fifth of H.

If the profile of the outer contours of a paving stone 1 is followed, for example in FIG. 4 with a certain rotational direction, it is established that the non-side parallel, sloping faces 7 are inclined such that they are all together either only rising or only falling with respect to their respectively associated paving stone side wall 8 to 11. With a direction of rotation for example in the clockwise direction in FIG. 4, all the sloping faces 7 are falling with respect to their respectively associated side walls 8 to 11.

Figure 6:
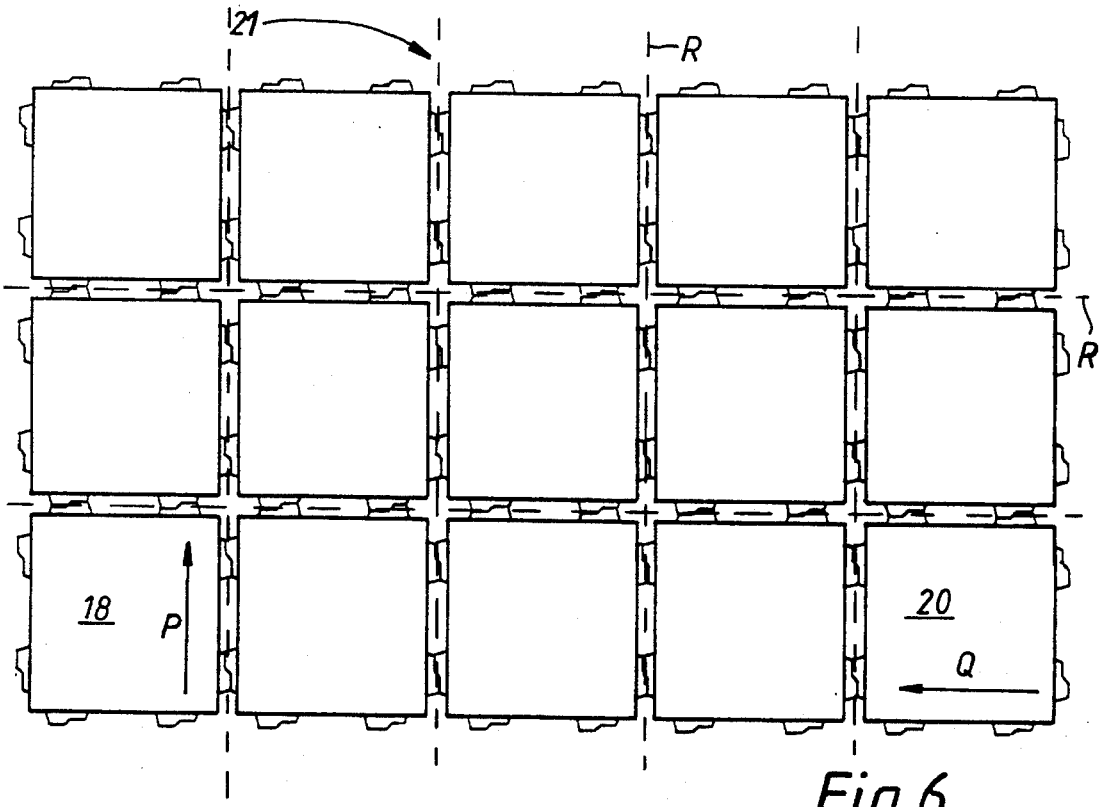
FIG. 6 shows a cross bond of paving stones according to FIG. 1.
Figure 7:
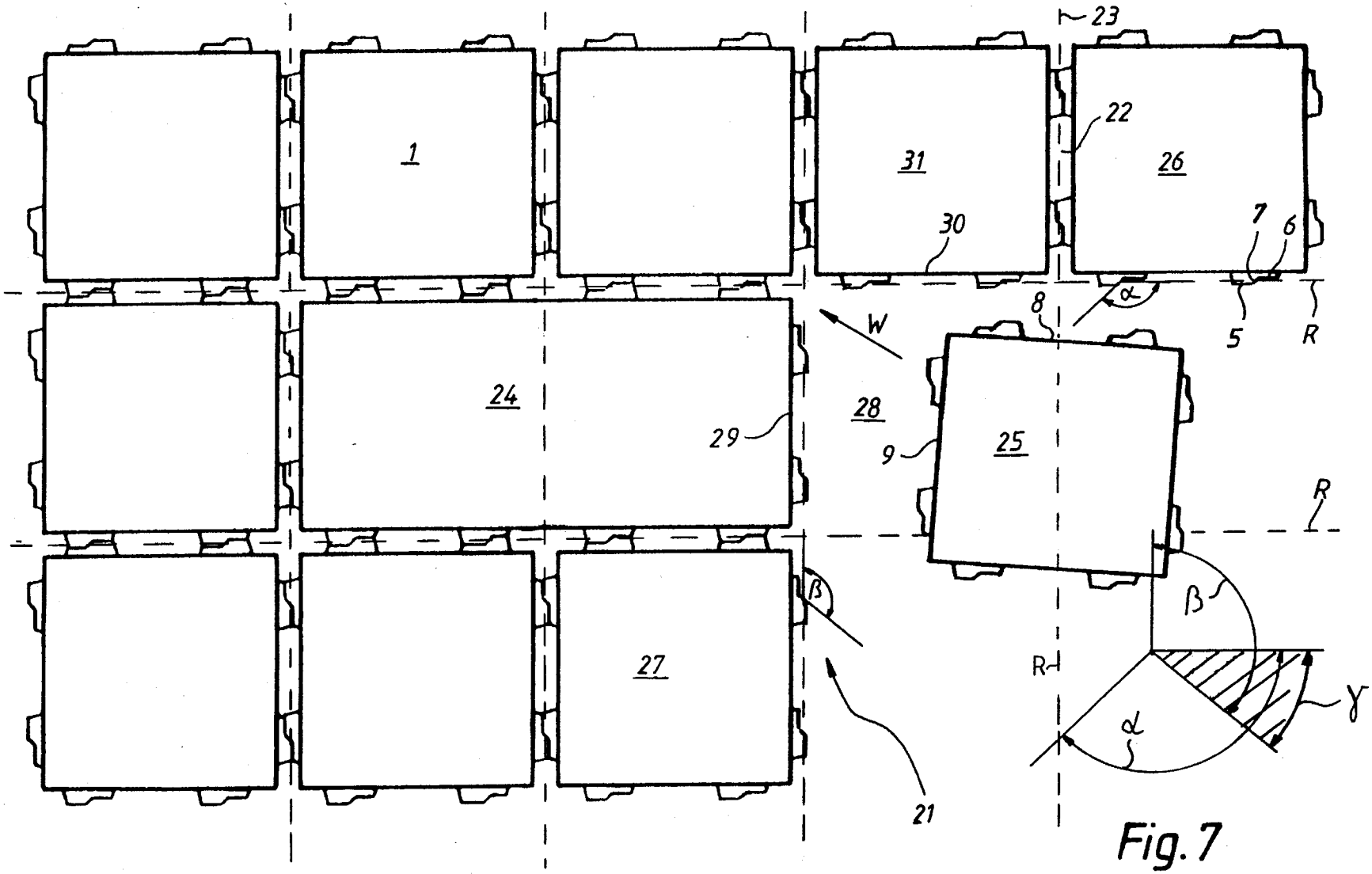
FIG. 7 shows a partially laid cross bond into which a new stone is just being fitted and FIG. 8 shows a bond with stone shapes of various sizes.

In FIGS. 5 to 7, a stretching bond and a cross bond of paving stones 1 according to the invention are respectively represented. The lattice lines R, which in the present cases form a rectangular grid with square lattice elements, are drawn in by dashed lines.

Due to the same configuration of the abutting faces of complementary spacers 12, 13, to be assigned to each other, of two opposite side walls 9, 11, the joining of the paving stones to each other by common interfaces 4 is possible.

Due to the sloping faces 7, in each case two complementary spacers 12, 13, to be assigned to each other, engage, meshing in one another. This meshing provides increased stability of the paving stone bond 19, 21. The individual paving stones are secured better against displacement in the lateral direction.

A special configuration of the abutting faces 4 can additionally achieve the effect that a paving stone 1 can be introduced by lateral displacement (arrow P or arrow Q) into a partially laid paving stone bond 19, 21 and can be joined on simultaneously by two sides. In the present case, this is achieved by the sloping faces 7 of the abutting faces 4 (see FIG. 4) being inclined such that they are either all rising or all falling with respect to their respective side wall 8 to 11 when running around the outer contour in a fixed rotational direction. In the plan view according to FIG. 4, for example, all the sloping faces 7 are falling with respect to their respective side wall 8 to 11, as stated above, when running around the outer contour in the clockwise direction.

In FIG. 6, two individual corner stones 18, 20 are marked by way of example, from the position of which in the paving stone bond 21 it is evident that they can be fitted into the paving stone bond 21 by lateral displacement in arrow direction P and in arrow direction Q, respectively.

The left-hand lower corner stone 18, for example, can be pushed in arrow direction P from below into the structure of the cross bond 21. The lower right-hand corner stone 20, for example, can be fitted in arrow direction Q from the right side. As soon as a stone is surrounded by neighboring stones on more than two sides, it is firmly anchored in its bond. The same considerations also apply, of course, to the stretching bond 19, represented in FIG. 5.

The spacers 12, 13 in the paving stone bond 19 protrude in each case beyond the center line 23 of a joint 22, the center line 23 dividing the non-side-parallel region 7 of each abutting face 4 of these spacers 12, 13. The center line 23 of the joint 22 coincides in the present case with a lattice line R. This does not necessarily have to be the case, but in the present case it is due to the fact that the paving stone side walls 8 to 11 are arranged in straight lines in square forms, all the spacers 3 being designed in the same manner. With side walls 8 to 11 of a curved design, there would, for example, be produced a likewise curved joint 22, the center line of which could, of course, no longer come into alignment with a straight lattice line.

The distance d between two spacers of one side corresponds exactly to half the sum of the side length L and a joint width F of a joint 22 transverse to this side 9, i.e. to the length $L_R$ of a lattice element ($d=L_R/2$). As a result, there are two different offsetting possibilities along this side direction. The one corresponds to the stretching bond 19 in FIG. 5, the other to the cross bond 21 in FIG. 6. If there were three spacers attached to the side wall 9, the respective distance d would have to be exactly ⅓ of the length $L_R$ of a lattice element, i.e. $d=L_R/3$, consequently it would be possible to realize a total of three offsetting possibilities.

In the partially laid cross bond 21 according to FIG. 7, the arrangement of the paving stones 1 in their bond can be clearly seen on account of the enlarged representation. With the rectangular paving stone 24 there is drawn in by way of example a stone shape which extends over two lattice elements. In an analogous way, paving stone shapes which may also extend over more than two lattice elements are also quite conceivable.

It can be seen from the paving stone 25 to be newly fitted in and also from the two bordering stones 26 and 27 under which preconditions a paving stone 25 to be fitted in can be fitted in by lateral displacement with two mutually adjacent paving stone sides 8, 9 simultaneously into an already cross-laid paving stone bond in its lattice element 28.

With one side, for example the side 8, the paving stone 5 would allow itself to be joined onto the paving stone 26 by a displacement direction at any angle within the angle range α. The angle α arises from the shape of the abutting face of the spacer.

In the present case, it represents the angle which the sloping face 7 assumes with respect to the stepped side-parallel regions 5, 6.

Similarly, it is immediately clear that the paving stone 25 can be fitted with its side 9, for example, against the bordering stone 27 at any push-in angle within the push-in angle range β. The push-in angle range β arises in a manner analogous to the angle range α.

If, then, the stone 25 is to be fitted simultaneously with its side 8 and with its side 9 against the side 29 of the stone 24 and against the side 30 of the paving stone 31, this is possible by lateral displacement precisely when the superposing of the two push-in angle ranges α and β for both sides gives a common angle range γ. Consequently, the paving stone 25 can be fitted into the lattice element 28 by lateral displacement in any direction within the angle range γ.

Figure 8:
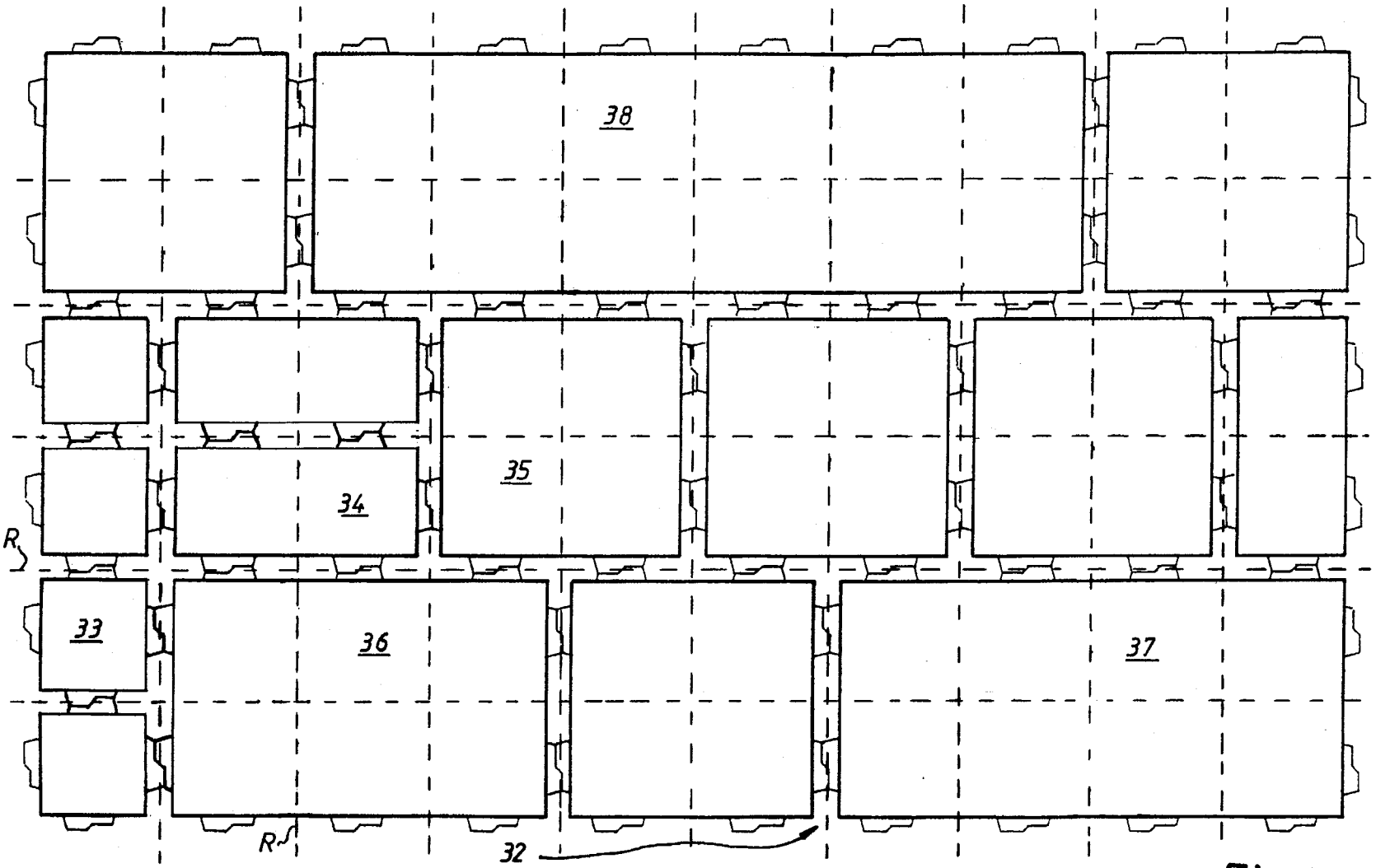

In FIG. 8, a paving stone bond 32 with a square lattice grid R is represented. In this exemplary embodiment, a plurality of stones of different sizes 33 to 38 are used. The smallest stone 33 in this case occupies precisely one lattice zone, while the largest stone 38 takes up a total of 12 lattice elements. However, all the paving stones 33 to 38 used in this bond 32 occupy an integral number of lattice elements. A paving stone bond 32 in which the smallest stone already occupies a plurality of lattice elements would of course also be conceivable.

Paving stone bonds and paving stone shapes according to the invention whose lattice elements are not square or else not rectangular are of course also conceivable. For example, a hexagonal shape, which produces a honeycomb structure likewise covering a surface area, or the shape of triangles, parallelograms (for example rhomboids), etc. would also be conceivable.

I claim:

1. A paving stone adapted to be arranged in a paving stone bond in an area-covering grid-shaped lattice of paving stones comprised of lattice elements, the paving stone comprising side walls and a plurality of spacers disposed on the side walls, each of the spacers having an abutting surface adapted to be positively joined to a respective abutting surface of a spacer on an adjacent paving stone in the lattice of paving stones thereby forming a crossing joint between the paving stones, whereby the abutting surface of each of the spacers includes a stepped contour for positively meshing with a corresponding stepped contour on the respective abutting surface of the spacer on the adjacent paving stone, the plurality of spacers being disposed on the side walls of the paving stone such that the stepped contours of their respective abutting surfaces are identically oriented in either of two rotational directions defined around the side walls of the paving stone.

2. The paving stone according to claim 1, wherein two opposite side walls of the paving stone each include an equal number of spacers disposed thereon and spaced identically with respect to one another.

3. The paving stone according to claim 2, wherein each of the side walls has spacers having identical abutting surfaces and being spaced with respect to one another by an amount equal to a length of a lattice element divided by the number of spacers per lattice element.

4. The paving stone according to claim 1, wherein the paving stone is configured to occupy an integral number of lattice elements of the lattice of paving stones.

5. The paving stone according to claim 1, and further defining, exclusive of its spacers, a parallelogram-shaped outline.

6. The paving stone according to claim 5, wherein the paving stone defines, exclusive of its spacers, a rectangular outline.

7. The paving stone according to claim 5, wherein the paving stone defines, exclusive of its spacers, a square outline, the respective side walls of the paving stone being symmetrical through a rotation of 90°.

8. The paving stone according to claim 1, wherein spacers disposed on opposite ones of the side walls of the paving stone are arranged at an identical height with respect to a length of their respective side walls.

9. The paving stone according to claim 1, wherein opposite ones of the side walls of the paving stone are symmetrical through a rotation of 180°.

10. The paving stone according to claim 1, wherein the plurality of spacers are identical, all crossing joints between adjacent paving stones thereby having equal widths.

11. The paving stone according to claim 1, wherein:

each crossing joint includes a lattice line corresponding to its center line; and the abutting surface of each of the plurality of spacers is designed such that the paving stone can be fitted along two crossing lattice lines into a partially laid bond by being laterally displaced to mesh with a corresponding abutting surface of a respective spacer disposed on either of two mutually adjacent paving stones in the bond.

12. The paving stone according to claim 1, wherein the stepped contour of the abutting surface of each of the plurality of spacers comprises:

two step regions disposed approximately parallel to and at a distance from an associated side wall of the paving stone; and a planar joining face joining the two step regions with one another and thereby being disposed at an angle with respect to the associated side wall, each spacer being disposed such that its joining face slopes in the same direction as joining faces of other spacers on the paving stone, all joining faces on the paving stone thereby sloping in one of an upward direction and a downward direction based on a given one of the rotational directions defined around the side walls of the paving stone.

13. The paving stone according to claim 12, wherein the joining face of each of the plurality of spacers is perpendicular to the associated side wall.

14. The paving stone according to claim 13, wherein each crossing joint includes a lattice line corresponding to its center line which intersects the joining face of each of the plurality of spacers by dividing the joining face into two equal halves in a direction perpendicular to a height of the joining face with respect to the associated side wall.

15. The paving stone according to claim 12, wherein each crossing joint includes a lattice line corresponding to its center line which intersects the joining face of each of the plurality of spacers.

16. The paving stone according to claim 12, wherein each of the plurality of spacers includes transitional faces joining the two step regions with the associated side wall and thereby being disposed at an angle with respect to the associated side wall.

17. The paving stone according to claim 16, wherein the transitional faces are perpendicular to the associated side wall.

18. The paving stone according to claim 12, further including an upper edge, a lower edge disposed at a distance H with respect to the upper edge, the distance H corresponding to a height of the paving stone, wherein the plurality of spacers are disposed at a distance a from the upper edge of the paving stone and aligned with the lower edge of the paving stone.

19. The paving stone according to claim 18, wherein is equal to one fifth of H.

* * * * *